US006478661B2

(12) United States Patent
Ohmori et al.

(10) Patent No.: US 6,478,661 B2
(45) Date of Patent: Nov. 12, 2002

(54) APPARATUS AND METHOD FOR PROCESSING MICRO-V GROOVES

(75) Inventors: Hitoshi Ohmori, Wako (JP); Noboru Ebizuka, Mitaka (JP); Yutaka Yamagata, Wako (JP); Shinya Morita, Tokyo (JP); Sei Moriyasu, Tokyo (JP); Muneaki Asami, Tokyo (JP)

(73) Assignees: Riken, Saitama (JP); The Nexsys Corporation, Tokyo (JP)

( * ) Notice: Subject to any disclaimer, the term of this patent is extended or adjusted under 35 U.S.C. 154(b) by 0 days.

(21) Appl. No.: 09/794,909

(22) Filed: Feb. 28, 2001

(65) Prior Publication Data

US 2001/0021629 A1 Sep. 13, 2001

(30) Foreign Application Priority Data

Mar. 3, 2000 (JP) ..... 2000-058133

(51) Int. Cl.[7] ..... B24B 1/00; B24B 49/00

(52) U.S. Cl. ..... 451/56; 451/21; 451/22; 451/57

(58) Field of Search ..... 451/21, 22, 56, 451/72, 443, 57

(56) References Cited

U.S. PATENT DOCUMENTS 3,938,492 A * 2/1976 Mercer, Jr. ..... 125/11.01
5,868,607 A * 2/1999 Enomoto et al. ..... 451/178
6,113,464 A * 9/2000 Ohmori et al. ..... 451/41
6,149,504 A * 11/2000 Ohmori et al. ..... 451/36
6,196,911 B1 * 3/2001 Preston et al. ..... 451/527
6,224,469 B1 * 5/2001 Ohmori et al. ..... 451/443
6,244,939 B1 * 6/2001 Ohmori et al. ..... 451/443

FOREIGN PATENT DOCUMENTS

JP 2000-237942 A 9/2000

OTHER PUBLICATIONS

Instrumentation for Ground–Based Optical Astronomy, "An Immersion Grating for an Astronomical Spectrograph", H. Dekker, pp. 183–188.

Applied Optics, vol. 32, No. 7, Mar. 1, 1993, "Immersion grating for infrared astronomy" G. Wudermann et al., pp. 1176–1178.

* cited by examiner

*Primary Examiner*—Timothy V. Eley
*Assistant Examiner*—Alvin J Grant
(74) *Attorney, Agent, or Firm*—Griffin & Szipl, P.C.

(57) ABSTRACT

A voltage is applied between a cylindrical cutting grindstone 2 that rotates about a vertical axis Y and a cylindrical truing grindstone 6 that rotates about a horizontal axis X. The vertical outer surface 2*a* and the horizontal lower surface 2*b* of the cutting grindstone are trued by a plasma discharge. Then without applying the voltage, the cutting grindstone 2 is trued mechanically by the truing grindstone 6, and while the outer periphery and lower surface of the cutting grindstone are dressed electrolytically, the outer periphery and lower surface are made to contact a workpiece 1 and process a micro-V groove. This method makes it possible to produce an immersion grating with a high resolution using hard, brittle materials such as germanium, gallium arsenide and lithium niobate.

6 Claims, 6 Drawing Sheets

L
ΔL=2L
Diffraction grating

L
ns
ΔL=(ns-1)L
Grism

L
ns
ΔL=2nsL
Immersion grating

Enlarged view of part A

APPARATUS AND METHOD FOR PROCESSING MICRO-V GROOVES

BACKGROUND OF THE INVENTION

1. Technical field of the Invention

The present invention relates to an apparatus and method for processing micro-V grooves for manufacturing immersion gratings.

2. Prior Art

When a large astronomical telescope is used to observe the motion of molecules existing in a low-temperature dark nebula, for instance, the telescope must have a resolution $r=\lambda/\Delta\lambda=200$ thousand for the 10 $\mu$m wavelength band. FIG. 1 shows the configuration of a mid-range infrared high dispersion spectrograph (IRHS) which has a resolution such as that described above. In FIG. 1, the IRHS analyzes infrared rays sent from a pre-optical system (camera), using a collimator-cum relay optical system, and observes the analyzed spectra using a collimator-cum camera. The collimator-cum relay optical system is composed of an incidence slit, a reflecting concave mirror, and an immersion grating, and in particular, the immersion grating reflects and analyzes the rays.

FIGS. 2A, 2B and 2C show the principles of the immersion grating; FIG. 2A illustrates a reflecting vertical surfaces of the V-grooves in FIG. 3B are coated with metal by vapor deposition and work as reflecting surfaces, so they must be finished so as to be precisely parallel to the incident surface, and have a mirror surface finish.

However, these fine V-grooves have been produced conventionally by, for example, laser abrasion. Consequently, the materials which could be processed were limited to easily machinable materials such as silicon, quartz, etc., and hard, brittle materials (refractory materials) such as germanium and gallium arsenide cannot substantially be machined by abrasion. In addition, the shape of the grooves cannot be machined precisely by the laser abrasion method, and the processed surface cannot be finished to give a mirror surface. Consequently, the above-mentioned immersion grating essentially cannot be produced using a hard, brittle material according to conventional methods.

Another conventional method of grinding, for example that of using a grindstone has problems due to the clogging or wear of the grindstone, and the shape of the grooves cannot be precisely maintained and also the bottoms of the grooves are circular arcs in shape, so essentially the grooves do not have the required reflecting surfaces. diffraction grating, FIG. 2B is a sketch of a transparent grism, and FIG. 2C shows a reflecting immersion grating. The immersion grating, as shown in FIG. 2C, is a reflecting diffraction grating with an optical path filled with a transparent medium, and its angular dispersion, that is, the optical path difference $\Delta L$ is given by 2nsL and is proportional to the refractive index of the medium. Therefore, its resolution $r=\lambda/\Delta\lambda$ is given by $2L/\lambda=2d \tan \theta/\lambda$ . . . (1)

Immersion gratings such as those described above are disclosed in "An Immersion Grating for an Astronomical Spectrograph" (HANS DEKKER), "Immersion grating for infrared astronomy" (APPLIED OPTICS, Vol. 32, No. 7, March 1993), etc.

Materials used for the aforementioned immersion gratings include germanium (Ge), gallium arsenide (GaAs), lithium niobate ($LiNbO_3$), and other optical elements suitable for infrared rays. These materials can transmit infrared rays with large refractive indices, although they are opaque to visible light. However, because these materials are hard and brittle, there is a problem that it is very difficult to machine the fine V-grooves.

More explicitly, as shown in FIGS. 3A and 3B, it is necessary to produce V-grooves as small as about 90 $\mu$m high and 233 $\mu$m wide accurately with a pitch of 4 grooves per millimeter on the grating surface of germanium or gallium arsenide, for instance, to achieve a resolution of 200 thousand in the 10 $\mu$m wavelength band. In addition, the

SUMMARY OF THE INVENTION

The present invention is aimed at solving these problems. In other words, an object of the present invention is to provide an apparatus and a method for processing micro-V grooves for an immersion grating with a high resolution, on a hard brittle material such as germanium, gallium arsenide and lithium niobate.

According to the present invention, a micro-V groove processing apparatus is provided and composed of an ELID grinding device (4) with a cylindrical cutting grindstone (2) that rotates about a perpendicular axis Y, and a rotary truing device (8) with a cylindrical truing grindstone (6) that rotates about a horizontal axis X; the aforementioned cutting grindstone (2) is provided with extremely fine grinding grains and a vertical outer periphery (2*a*) and a horizontal lower surface (2*b*) that grind the workpiece (1); the above-mentioned rotary truing device (8) forms the shape of the outer periphery and the lower surface of the grindstone by plasma-discharge truing and mechanical truing.

The present invention also provides a micro-V groove processing method wherein a voltage is applied between the cylindrical cutting grindstone (2) that rotates about the vertical axis Y and the cylindrical truing grindstone (6) that rotates about the horizontal axis X, thus by means of the plasma discharge, the shape of the vertical outer periphery (2*a*) and the horizontal lower surface (2*b*) of the grindstone are trued. Next the cutting grindstone (2) is mechanically trued by the truing grindstone (6) without applying a voltage, and while the surface of the trued grindstone is in contact with the workpiece (1) to form the micro-V grooves its outer periphery is dressed electrolytically.

According to a preferred embodiment of the present invention, the aforementioned plasma-discharge truing and mechanical truing can keep the radius of curvature of the circular edge between the vertical outer periphery (2*a*) and the horizontal lower surface (2*b*) of the grindstone less than 20 $\mu$m.

Using the above-mentioned apparatus and method according to the present invention, the rotary truing device (8) maintains the shape of the outer periphery and the lower surface of cutting grindstone (2) by means of both plasma-discharge truing and mechanical truing, and can keep the shape of the circular edge between the vertical outer periphery (2*a*) and the horizontal lower surface (2*b*) of the cutting grindstone to a radius of curvature of 20 $\mu$m or less. As a result, by using the cylindrical cutting grindstone (2) with extremely fine grinding grains formed in this way, the workpiece is ground by the cutting grindstone and is at the same time dressed electrolytically. So the workpiece can be ground to produce very excellent processed surfaces without having the grindstone becoming clogged, with the surfaces having a finish as good as a mirror. Therefore, an immersion grating with a high resolution can be manufactured using a hard brittle material such as germanium, gallium arsenide and lithium niobate.

The above-mentioned cutting grindstone (2) is a metal-bonded diamond grindstone using diamond grinding grains with a mean grain diameter of 1 μm or less, and the aforementioned truing grindstone (6) is a metal-bonded diamond grindstone with diamond grinding grains.

This configuration allows the cutting grindstone (2) to be dressed electrolytically and to be trued by plasma discharge by the truing grindstone, and in addition, the cutting grindstone (2) can be trued mechanically by the truing grindstone (6).

The discharge voltage power supply (10) is provided to apply a voltage between the above-mentioned cutting grindstone (2) and the truing grindstone (6) to produce a plasma discharge.

The cutting grindstone (2) is connected to the positive terminal of the above-mentioned power supply, and the truing grindstone (6) to the negative terminal thereof, and voltage pulses are applied between the grindstones to produce a plasma discharge, thereby the cutting grindstone (2) can be trued with the truing grindstone (6) by the plasma discharge.

Other objects and advantages of the present invention are revealed in the following paragraphs referring to attached drawings.

DESCRIPTION OF PREFERRED EMBODIMENTS

Figure 1:
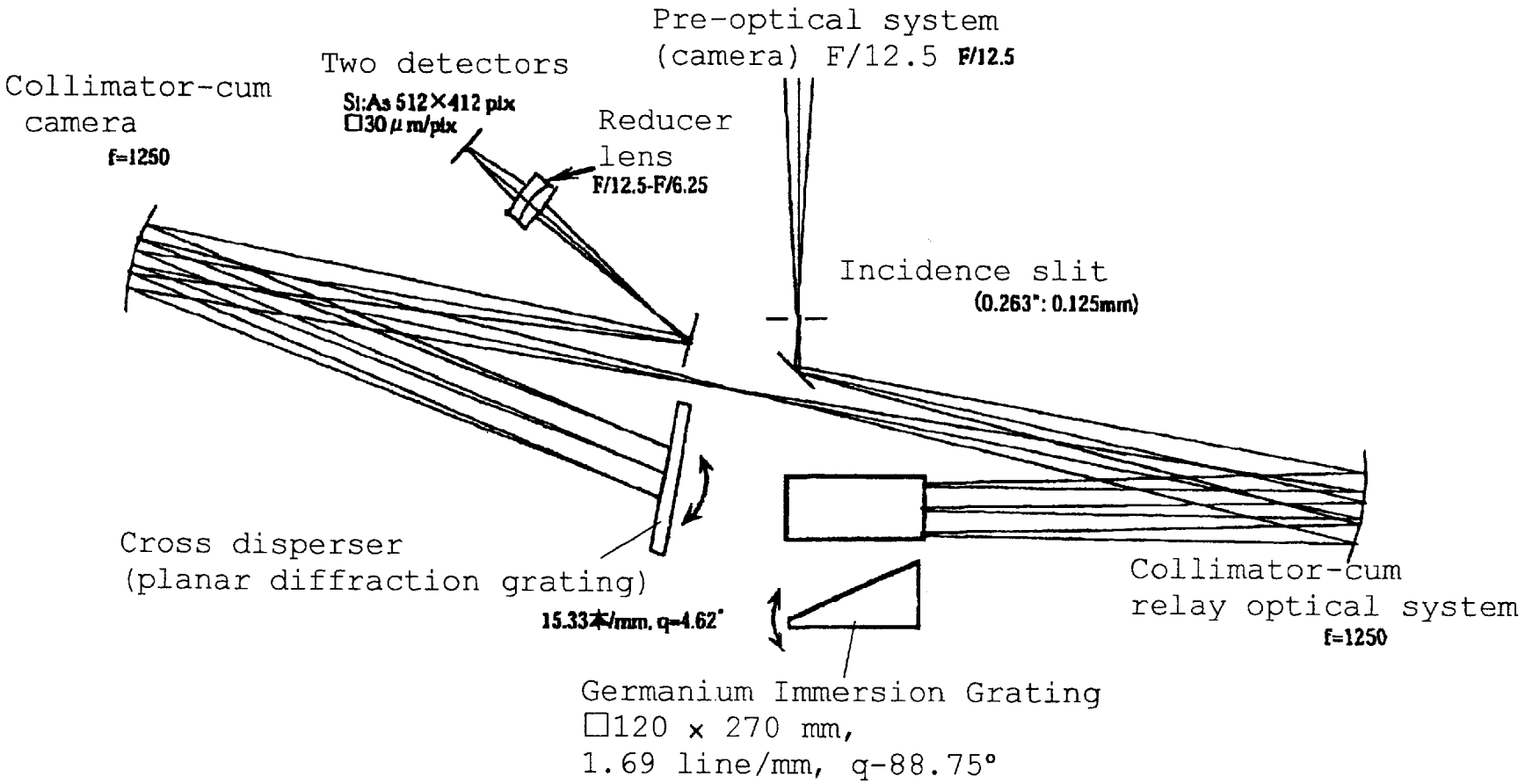
FIG. 1 shows the configuration of a mid-infrared ray high-dispersion spectrograph.
Figures 2A, 2B, 2C:
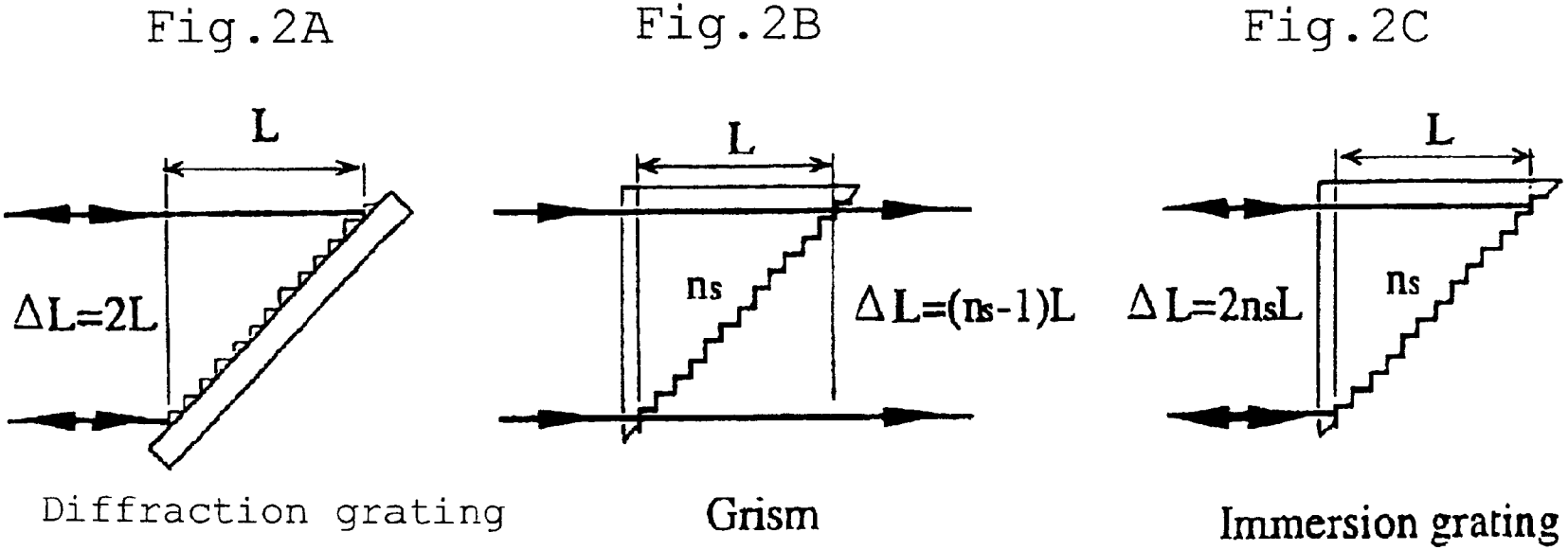
FIGS. 2A, 2B and 2C illustrate the principles of an immersion grating.

The following paragraphs describe preferred embodiments of the present invention referring to the drawings. Common portions in each drawing are identified using the same reference numbers.

As modern science and technology have been making significant progress recently, the demand for ultra-precision processing has drastically increased, and as a means of grinding a mirror surface to satisfy the demand, the inventors of the present invention, et al. developed and disclosed an electrolytic in-process dressing method (ELID grinding method, Riken Symposium "Recent Trends of Mirror Surface Grinding Technology," held on Mar. 5, 1991).

According to this ELID method, a conducting grindstone is used in place of the electrode used in a conventional electrolytic grinding system, and an electrode is provided opposite the grindstone with a space between them, and while a conducting liquid is made to flow between the grindstone and the electrode, a voltage is applied between the grindstone and the electrode, thus while a workpiece is being ground by the grindstone, the grindstone is being dressed electrolytically. That is, the metalbonded grindstone is connected to the positive terminal of a power supply, and the electrode placed opposite the surface of the grindstone with a gap between them is connected to the negative terminal thereof, and during a grinding operation, the grindstone is dressed electrolytically, thereby keeping the performance of the grinding operation stable.

According to this ELID grinding method, even if fine grinding grains are used, the grindstone is not clogged as the grinding grains are sharpened by electrolytic dressing, therefore a very excellent surface like a mirror surface can be obtained with microscopic grinding grains.

Figure 4:
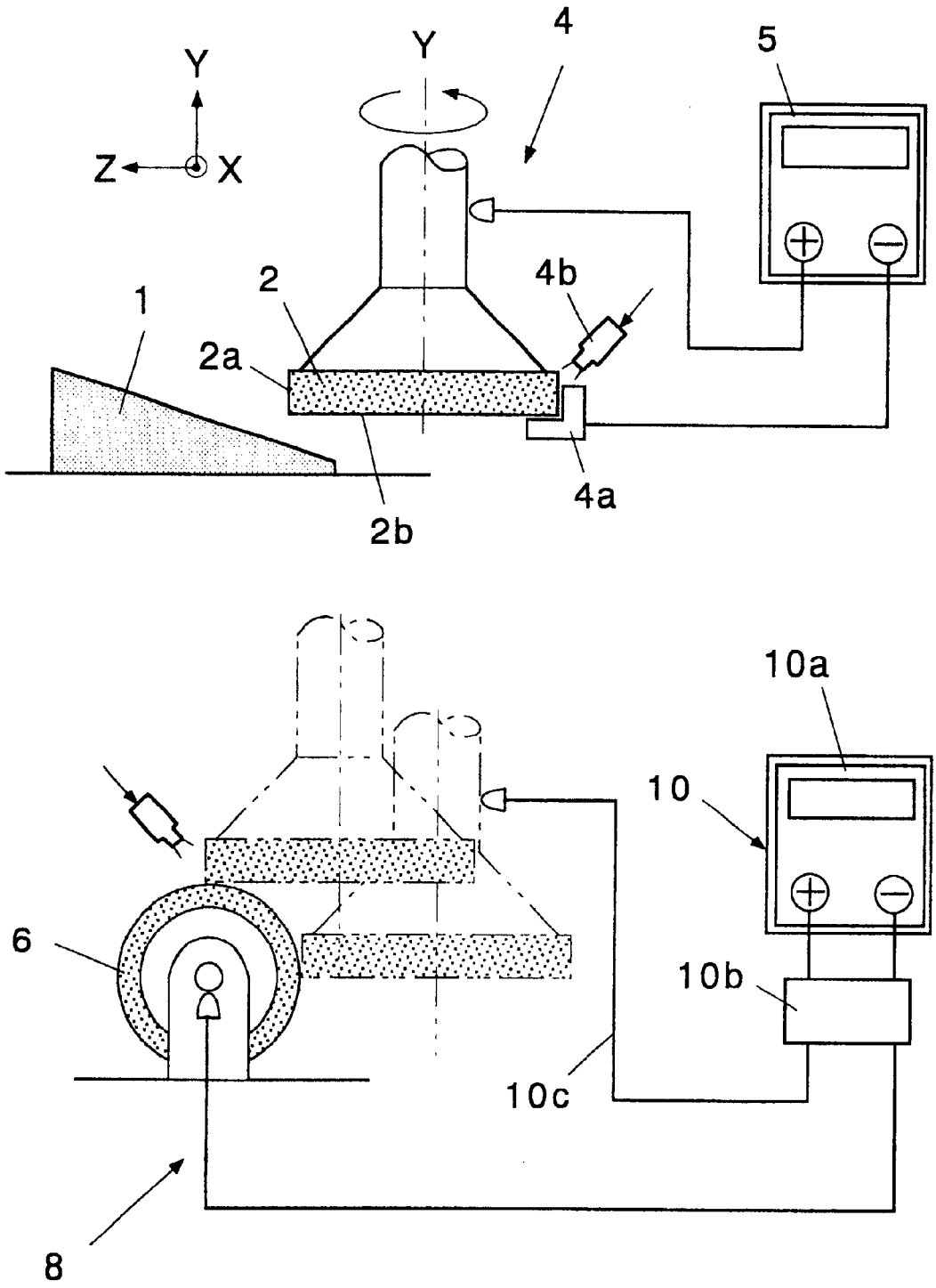
FIG. 4 shows the configuration of a micro-V groove processing apparatus according to the present invention.

FIG. 4 shows the configuration of a micro-V groove processing apparatus according to the present invention. In FIG. 4, the micro-V groove processing apparatus of the present invention is composed of an ELID grinding device 4 and a rotary truing device 8.

The ELID grinding device 4 is provided with a cylindrical cutting grindstone 2 that rotates about a vertical axis Y. This cutting grindstone 2 is, in this example, a cast iron bonded diamond grindstone with diamond grinding grains with a mean grain diameter of 1 μm or less. The ELID grinding device 4 is also composed of an ELID electrode 4*a* facing the grindstone 2 with a gap between them and an ELID power supply 5, and while a conducting liquid is made to flow between the grindstone 2 and the electrode 4*a*, the power supply applies a voltage between the grindstone and the electrode and while the grindstone (2) is being electrolytically dressed, grindstone 2 is numerically controlled in the directions of the three axes X-Y-Z and grinds the workpiece 1. In FIG. 4, the reference number 4*b* indicates the nozzle for supplying the conducting liquid.

The rotary truing device 8 is comprised of a cylindrical truing grindstone 6 that is driven so as to rotate about the horizontal axis X (orthogonal to the paper surface in FIG. 4). In this example, the truing grindstone 6 is a bronze-bonded diamond grindstone using diamond grinding grains. In addition, a discharge voltage power supply 10 is also provided that applies a voltage between the cutting grindstone 2 and the truing grindstone 6 to produce plasma discharges. The discharge voltage power supply 10 is composed of a DC power supply 10*a*, a pulse discharge circuit 10*b* and a current feed line 10*c*, and is arranged to repeatedly output low-voltage micro-discharges, and trues the processing surface of the cutting grindstone 2.

According to the method of the present invention using the aforementioned micro-V groove processing apparatus, a voltage is produced by the discharge voltage power supply 10, and applied between the cutting grindstone 2 and the truing grindstone 6, causing a plasma discharge. The vertical outer periphery 2*a* and the horizontal lower surface 2*b* of the cutting grindstone can be trued by this plasma discharge. Next, without applying any voltage, the truing grindstone 6 mechanically trues the cutting grindstone 2, without interrupting the process.

In the above-mentioned way, plasma-discharge truing and mechanical truing are combined operations, high-speed and high-efficiency truing can be carried out by plasma-discharge truing, and the mechanical truing can form a cutting edge with a radius of curvature as sharp as 20 μm or less.

Next, the sharp cutting edge of the grindstone, thus formed, is placed in contact with the workpiece 1 and a micro-V groove is processed and at the same time the outer periphery and lower surface of the cutting grindstone are electrolytically dressed to sharpen the circular cutting edge.

According to the above-mentioned apparatus and method of the present invention, the rotary truing device 8 is used for both plasma-discharge truing and mechanical truing, and shapes the outer periphery and lower surface of the cutting grindstone 2, thereby the radius of curvature of the cutting edge between the vertical outer periphery 2*a* and the horizontal lower surface 2*b* of the cutting grindstone can be sharpened to 20 μm or less. Therefore, while using the cylindrical cutting grindstone 2 with extremely fine grinding grains, formed as above, and electrically dressing the cutting grindstone, the workpiece is ground by this grindstone, and as a consequence, a very excellent surface with a mirror-like-finish can be ground without the grindstone becoming clogged, therefore, an immersion grating with a high resolution can be produced on a hard, brittle material such as germanium, gallium arsenide and lithium niobate.

[Embodiments]

Figure 5:
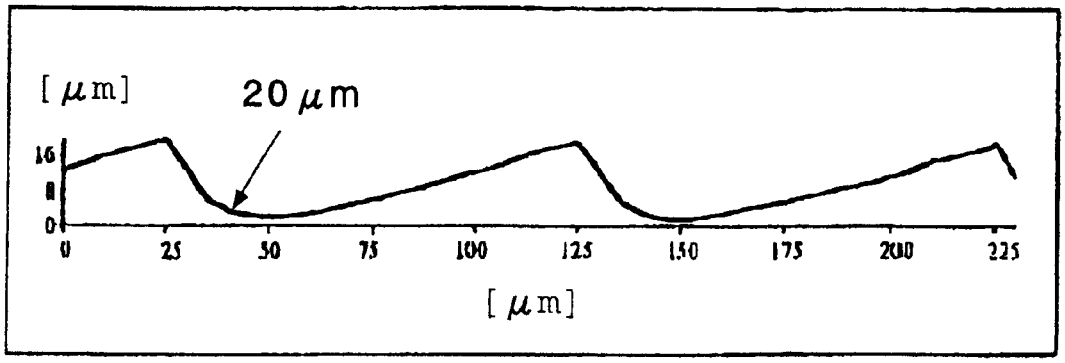
FIG. 5 shows the results of measuring the shape of the grooves according to an embodiment of the present invention.

FIG. 5 shows a result of measuring a shape produced by an embodiment of the present invention. In this embodiment, diamond grinding grains with a grit size of #20000 (with a mean grain diameter of about 0.8 μm) were used for the cutting grindstone, and a germanium immersion grating was cut.

Figure 3A:
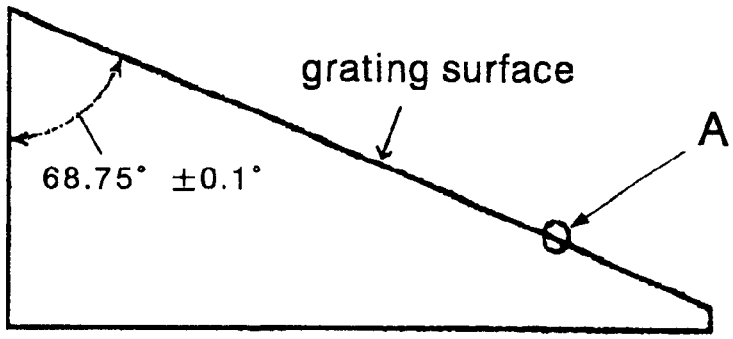
FIGS. 3A and 3B show the shape of an immersion grating.
Figure 3B:
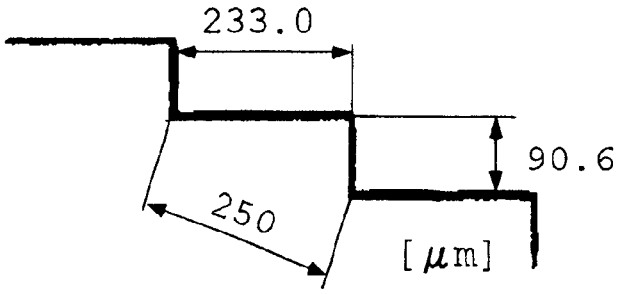

FIG. 5 shows the measured shape of a-section after processing (part A of FIG. 3A) . FIG. 5 reveals that the angle between the vertical outer periphery 2*a* and the horizontal lower surface 2*b* of the cutting grindstone is precisely 90° after processing, and the radii of the corners of the grooves are about 20 μm. In addition, the roughness of the processed surface was excellent, nearly like a mirror surface. Consequently, this germanium immersion grating could be applied to the mid-infrared ray high-dispersion spectrograph shown in FIG. 1, although the radii of curvature of the groove corners are slightly large (the closer to 0, the better), and the reflecting efficiency was correspondingly slightly reduced.

Figure 6A:
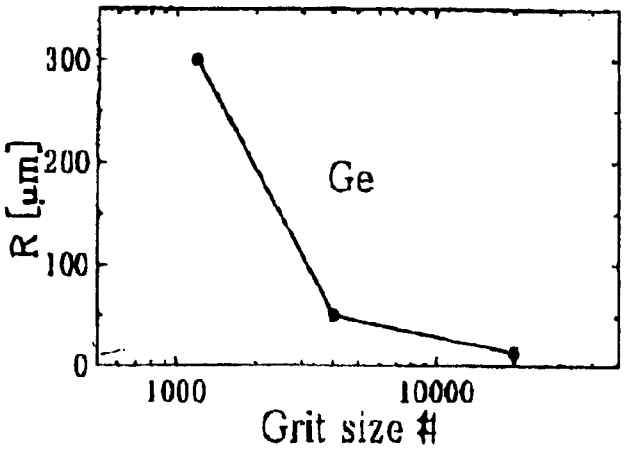
FIGS. 6A, 6B and 6C show relationships between the sizes of the grinding grains and the radii of the bottom of the grooves according to the embodiments of the present invention.
Figure 6B:
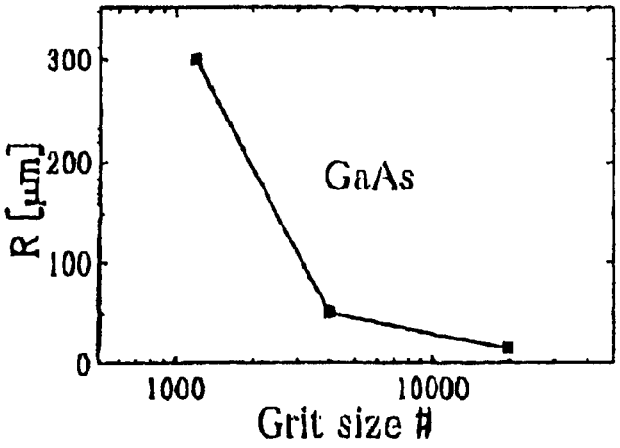
Figure 6C:
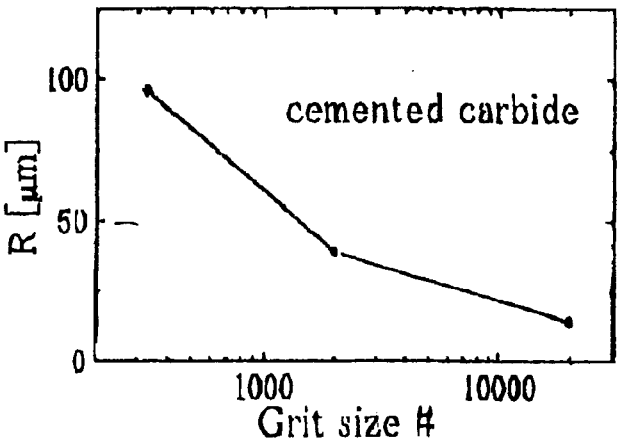

FIGS. 6A, 6B and 6C show the relationships between the grit sizes and the radii of curvatures of the corners at the bottom of the grooves produced by embodiments according to the present invention. FIGS. 6A, 6B and 6C relate to workpieces made of germanium (Ge), gallium arsenide (GaAs) and cemented carbide material. In each drawing grit sizes are plotted as the ordinate and the radii of curvature of the corner at the bottom of the processed groove in μm units is plotted as the abscissa.

As shown in FIGS. 6A, 6B and 6C, it has been confirmed that the larger the grit sizes used in the cutting grindstone, the smaller the radii of curvature of the corners at the bottom of the processed grooves can be made, and that with either germanium, gallium arsenide or cemented carbide, if a grit size of #20000 (a mean grain diameter of about 0.8 μm) is used, a radius of curvature of about 15 μm can be realized at the bottom of the processed groove. Therefore, by using a cutting grindstone with grinding grains with a smaller mean grain diameter, the radii of curvature of the bottom of the processed grooves can be further reduced and the smoothness of the processed surface can be made even better.

As described above, the micro-V groove processing apparatus and method according to the present invention provides the desired effects including that an immersion grating with a high resolution can be produced using a hard brittle material such as germanium, gallium arsenide and lithium niobate.

As a matter of course, the present invention should not be limited only to the aforementioned embodiments, but instead should include various modifications as long as they do not deviate from the claims of the invention.

What is claimed is:

1. A micro-V groove processing method, wherein a voltage is applied between a cylindrical cutting grindstone that rotates about a vertical axis Y and a cylindrical truing grindstone that rotates about a horizontal axis X, and the vertical outer periphery and horizontal lower surface of the cutting grindstone are trued by a plasma discharge, then the cutting grindstone is trued mechanically by the truing grindstone without applying a voltage, and the outer periphery and lower surface are made to contact a workpiece and process a micro-V groove while the outer periphery and lower surface are being dressed electrolytically.

2. The micro-V groove processing method specified in claim 1, wherein the radius of a curvature of the circular edge between the vertical outer periphery and horizontal lower surface of the cutting grindstone is formed to be 20 μm or less.

3. A micro-V groove processing apparatus comprising an ELID grinding device with a cylindrical cutting grindstone that rotates about a vertical axis Y and a rotary truing device with a cylindrical truing grindstone that rotates about a horizontal axis X, wherein the cutting grindstone comprises extremely fine grinding grains, and a vertical outer periphery and a horizontal lower surface for processing a workpiece, and the rotary truing device "shapes, by plasma-discharge truing and mechanical truing, an outer periphery and lower surface of" the cutting grindstone.

4. The micro-V groove processing apparatus specified in claim 3, wherein the cutting grindstone comprises a metal-bonded diamond grindstone comprised of diamond grinding grains with a mean grain diameter of 1 μm or less, and the truing grindstone is a metal-bonded diamond grindstone comprised of diamond grinding grains.

5. The micro-V groove processing apparatus specified in claim 4, further comprising a discharge voltage power supply that applies a voltage between the cutting grindstone and the truing grindstone and produces plasma discharges.

6. The micro-V groove processing apparatus specified in further comprising a discharge voltage power supply that applies a voltage between the cutting grindstone and the truing grindstone and produces plasma discharges.

* * * * *